US006179134B1

(12) United States Patent
Pine et al.

(10) Patent No.: US 6,179,134 B1
(45) Date of Patent: Jan. 30, 2001

(54) EXPANDABLE DISH RACK

(76) Inventors: Eli S. Pine; Berit Pine, both of 370 River Rd., Nutley, NJ (US) 07110

( * ) Notice: Under 35 U.S.C. 154(b), the term of this patent shall be extended for 0 days.

(21) Appl. No.: 09/435,886

(22) Filed: Nov. 6, 1999

Related U.S. Application Data

(60) Provisional application No. 60/107,834, filed on Nov. 10, 1998.

(51) Int. Cl.[7] ..... A47G 19/08

(52) U.S. Cl. ..... 211/41.3; 312/228.1

(58) Field of Search ..... 211/41.2, 41.3, 211/41.6, 2, 126.15; 4/637, 638, 656; 108/13, 14, 16; 312/205, 299, 301, 228.1, 229; D32/55–57

(56) References Cited

U.S. PATENT DOCUMENTS

| | | | | |
|---|---|---|---|---|
| D. 353,921 | * | 12/1994 | Lippisch et al. | D32/55 |
| D. 414,306 | * | 9/1999 | Hollinger | D32/55 |
| 801,275 | * | 10/1905 | Silk | 4/656 |
| 928,062 | * | 7/1909 | Moletor | 4/656 |
| 958,857 | * | 5/1910 | Dennis | 4/656 |
| 1,264,702 | * | 4/1918 | Soderstrom | 211/41.3 |
| 1,356,305 | * | 10/1920 | Newton | 211/41.3 |
| 1,660,210 | * | 2/1928 | Schaefer | 312/205 |
| 1,789,232 | * | 1/1931 | Hertz | 211/41.3 |
| 1,889,146 | * | 11/1932 | Kalenoff | 211/41.3 |
| 1,889,218 | * | 11/1932 | Reedy | 312/205 |
| 1,961,391 | * | 6/1934 | Reedy et al. | 312/205 |
| 2,443,404 | * | 6/1948 | Tallarico | 211/41.3 |
| 2,632,568 | * | 3/1953 | Abt | 211/41.3 |
| 2,701,932 | * | 2/1955 | Hyman | 312/205 |
| 2,936,898 | * | 5/1960 | Miguez | 211/41.3 |
| 3,339,994 | * | 9/1967 | Reddig et al. | 312/205 |
| 3,465,894 | * | 9/1969 | Setecka | 211/126.15 |
| 4,169,638 | * | 10/1979 | Cirasuolo et al. | 211/41.3 |
| 4,480,343 | * | 11/1984 | Drach | 4/656 |
| 4,531,641 | * | 7/1985 | Archambault | 211/41.3 |
| 4,799,744 | * | 1/1989 | Toy | 312/229 |
| 5,158,184 | * | 10/1992 | Craft et al. | 211/41.3 |
| 5,330,063 | * | 7/1994 | Remmers | 211/126.15 |
| 5,607,213 | * | 3/1997 | Slivon et al. | 312/301 |
| 5,704,492 | * | 1/1998 | Bartko | 211/41.3 |
| 5,887,961 | * | 3/1999 | Rosenberg et al. | 312/205 |

* cited by examiner

*Primary Examiner*—Daniel P. Stodola
*Assistant Examiner*—Jennifer E. Novosad

(57) ABSTRACT

An expandable dish rack contains a drawer-like tray within and in the bottom of the dish rack. Water from dishes on the dish rack drains through frontal slots in the downwardly slanted floor into the tray. If additional dish space is required, the tray is drawn outwards, acting as an extended dish rack and a drainage board. In this position water drains through the same frontal slots and collects in the tray. The floor slots in the dish rack permit water drainage only into the tray whether the tray is in its outward or withdrawn position. The spaced apart ridges on the tray keep dishes above the collected water on the bottom surface of the tray. The tray is removable and the water is expelled therefrom.

1 Claim, 6 Drawing Sheets

EXPANDABLE DISH RACK

This application claims the benefit of priority pursuant to 35 USC 517 119(e)(1) from the provisional patent application filed pursuant to 35 USC 517 119(b): as Ser. No. 60/107,834 filed on Nov. 10, 1998.

BACKGROUND OF THE INVENTION

1. Field of the Invention

Where kitchen space is at a premium it is desirable to have a dish rack that occupies as little space as possible yet embodies all the necessary requirements of a dish rack.

2. The Prior Art.

In domestic kitchens, it is common to use a dish rack adjacent to the kitchen sink for the collection of wet dishes subsequent to the manual washing of the dishes in the sink. Typically the dishes are rinsed and placed in specialized compartments in the rack, still wet. A series of apertures and through slots extend through the bottom of the rack's compartment, through which water from the dishes is drained off by gravity.

A mat or tray, composed either of rubber or plastic, is generally sold with the rack, for intended use with the rack. The tray in use is positioned beneath the rack and includes a central platform area, bounded by raised sidewalls on which the rack is supported. The drainage water from the racked dishes collects in the platform area, out of contact with the dishes, whereby accelerating their drying. Some trays in common use, such as that shown in U.S. Pat. No. 4,531,641 and D353,921 provide an outlet lip at one end of the platform area, which is draped over the sink. Other trays merely collect the water in the platform area, for eventual disposition by way of evaporation. U.S. Pat. No. 5,158,184 uses a drain board for packaging and use as a storage container lid.

While the above products are well accepted in the trade and have met with commercial success, several shortcomings prevent existing rack and tray sets from satisfying some of the consumer needs. In general, where kitchen space is a premium, for example in the small kitchen in large cities such as New York City, an even more compact feature of the dish rack would be desirable. As such, a separate mat or tray, to collect the water coming off the dishes, is omitted in this invention because the Expandable Dish Rack includes a bottom drawer through which the drained water is collected. The topmost part of the Expandable Dish rack has a sloping floor that conducts rinsed water into the below tray through slots in its front part. Whether the tray rests within the body of the Dish Rack or is extended outward, the rinsed water is conducted through slots into the below tray. Dishes rest on the tray which has spaced ridges which keep the dishes out of contact with the water collected on the base of the tray. The tray is later removed and the water expelled.

SUMMARY OF THE INVENTION

The present invention overcomes certain shortcomings in the state of the art dish rack and tray sets. This invention has a bottom drawer-like tray supported by a track underneath the dish rack that allows the tray to extend outwards and thus act as both an additional dish rack and a water collector capable of holding dishes above the surface of the collected water by means of spaced ridges. For example with only a few dishes to dry, the tray need not be extended outward because the dish rack meets the space needs. A slope in the floor of the rack causes the water from the dishes, cups, silverware, etc. to drain by gravity through slots onto the tray below. Should more dish space be required the bottom tray is pulled out acting as an extended dish rack and a drain. In this outward position the rinsed water drains through the slots into the tray in the same way as when the tray is not extended. Dishes remain above the rinsed water by means of spaced ridges on the surface of the tray. The tray is removable for discarding the collected water.

DESCRIPTION OF THE PREFERRED EMBODIMENTS

Figures 1, 2:
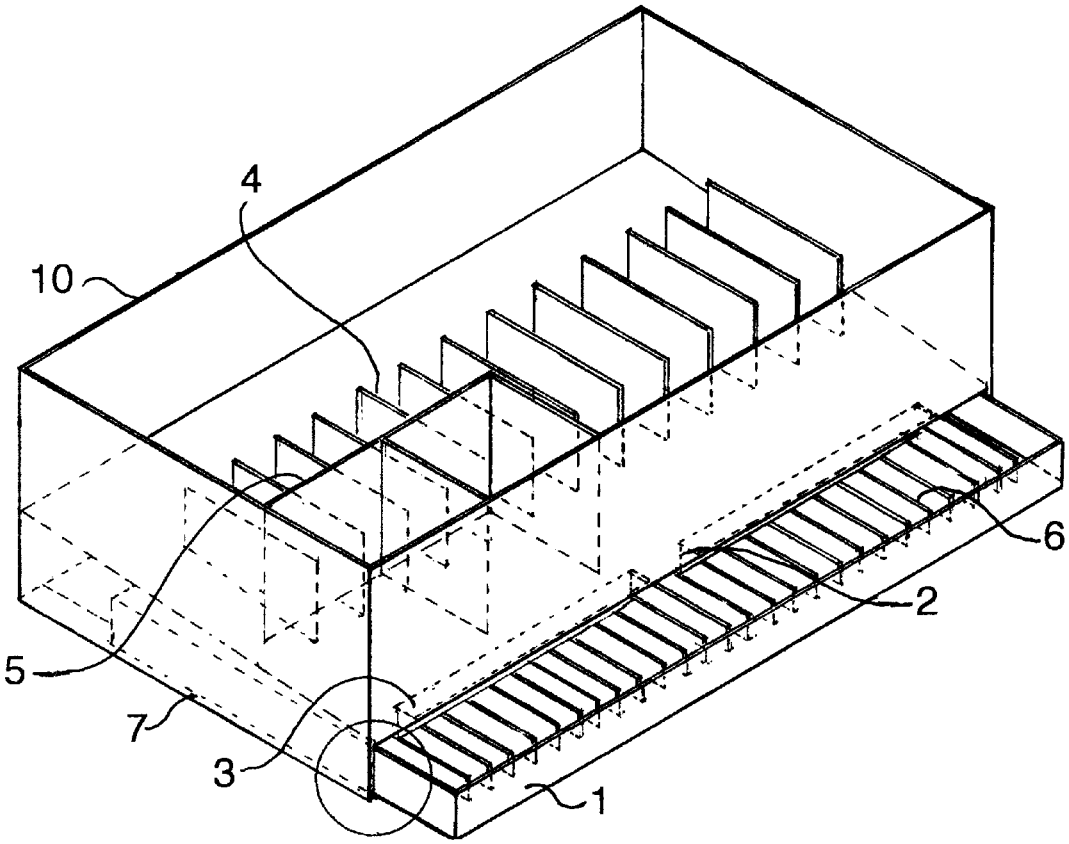
FIG. 1 is a perspective view of the dish rack with the tray partially extended.
FIG. 2 is a detail of FIG. 1, with a view of the corner of the dish rack.
Figure 2:
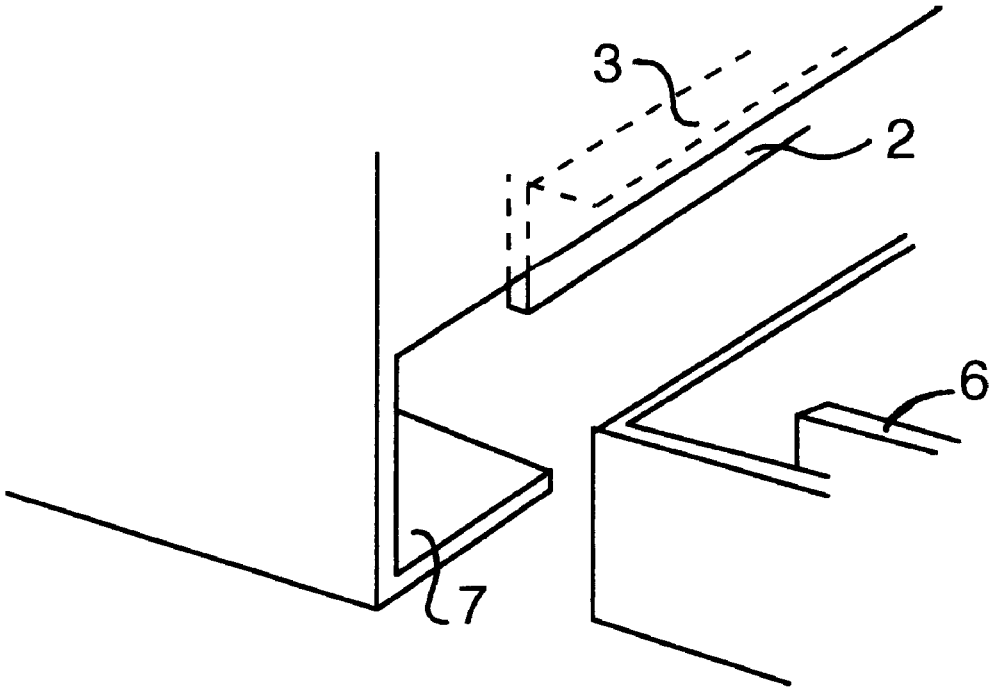

Referring to FIG. 1, the removable tray and water collector 1 is partially extended from the dish rack 10. The tray stopper 2 prevents the tray from being inadvertently pulled completely out and separated from the dish rack. Drain slits 3 channel the rinsed water from the dish rack to accumulate into the below tray. Plate holder 4 and cutlery holder 5 allow plates and silverware to be held upright. The tray has stacking ribs 6, which serve as cup holders in the extended position. Tray guides, side runners, 7 hold the tray and permit the movement of the tray in and out.

Referring to FIG. 2, is a perspective of FIG. 1 showing the tray stopper 2, the drain slits 3, the cup holders 6 and a tray guide 7.

Figure 3:
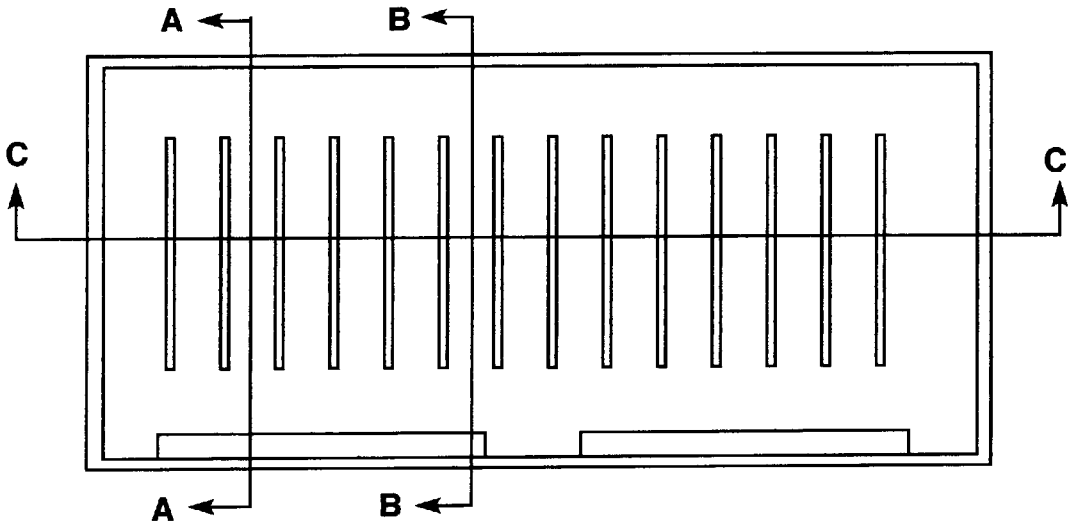
FIG. 3 is a top plan view of the dish rack without the tray.

Referring to FIG. 3, a top plan view of the dish rack without the tray, indicates sections A—A, B—B, and C—C.

Figure 4:
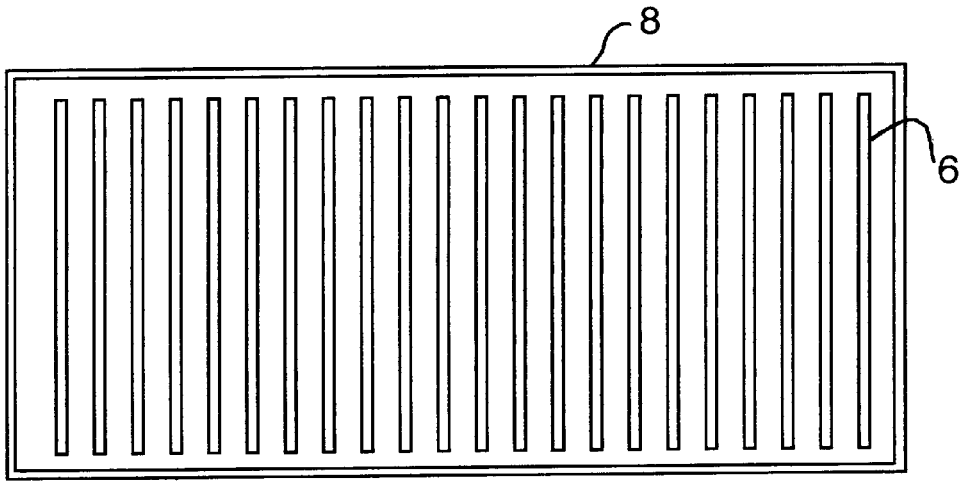
FIG. 4 is a top plan view of the tray.

Referring to FIG. 4, is a top plan view of the tray showing the side walls 8 and cup holders 6.

Figure 5:
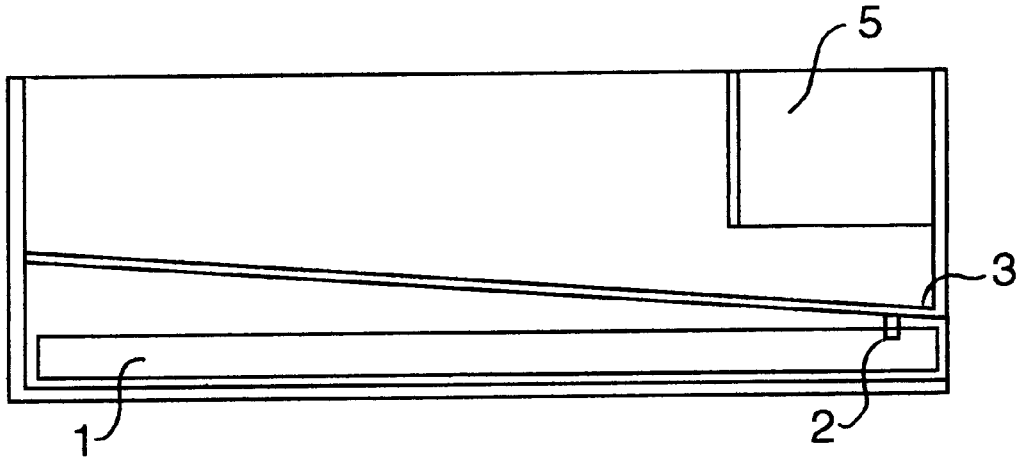
FIG. 5 is sectional side view A—A with the tray in retracted position.

Referring to FIG. 5, is a side sectional view A—A, shows the tray 1 in retracted position, the tray stopper 2, the drain slits 3, and the cutlery holder 5.

Figure 6:
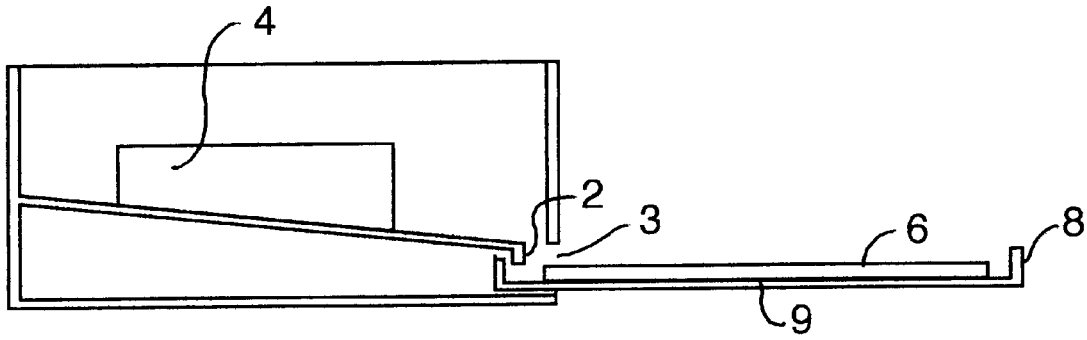
FIG. 6 is sectional side view B—B with the tray in extended position.

Referring to FIG. 6, is a side sectional view B—B, shows the slanted floor 9 to run off the dishwater into the tray in the extended position, the tray stopper 2, the tray side walls 8, the drain slit 3, plate holders 4, and cup holders 6 that keep the cups out of contact with the drainage water on the floor of the tray.

Figure 7:
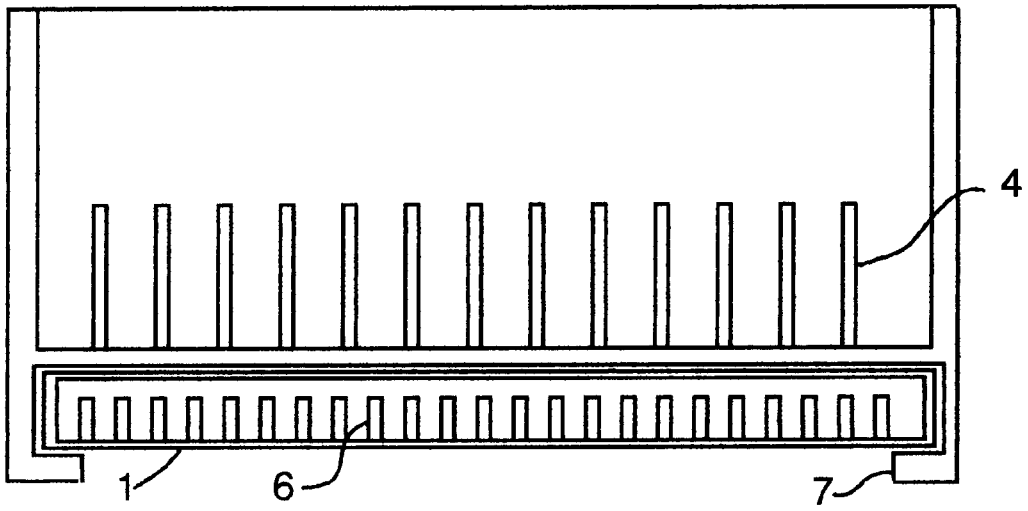
FIG. 7 is a front view C—C with tray resting on the side runners.

Referring to FIG. 7, is a front sectional view C—C, shows the tray 1, with cup holders 6, plate holders 4, and the tray guides 7.

While the above describes the preferred embodiment, the invention so described is not to be so restricted. Other embodiments which utilize the teachings herein set forth are intended to be within the scope and spirit of the subject invention.

What is claimed is:

1. An expandable dishrack assembly comprising:

a dish draining rack having a pair of sidewalls, a rear wall, a front wall, and a continuously slanted solid floor being disposed at an inclined angle with respect to the horizontal, whereby a top-opening dishware containing compartment is formed therebetween for storing a plurality of dishes; the sidewalls each having a side runner attached to a bottom edge thereof and perpendicular thereto; and the floor having at least one slit disposed adjacent the front wall of the dish rack and at least one downwardly extending projection defining a stop located adjacent the at least one slit;

a removable tray, having a front and back, located below the floor of the dish rack, and having a walled rim and a continuously solid bottom surface with spaced apart raised ridges disposed thereon whereby the height of the ridges is such that dishes placed on the ridges are out of direct contact with the bottom surface; the tray rests on the pair of side runners, such that the tray can slide inwards and outwards along the side runners, with the at least one stop extending below the rim of the tray so that the at least one stop contacts and intercepts the rim and prevents complete and inadvertent removal of the tray from the dish rack;

whereby when a dish is placed in the dishware containing compartment, liquid that is located on the dish is drained off and directed down the slanted floor of the dish rack, through the at least one slit and collected in the tray located there below.

* * * * *